United States Patent [19]

Schriber et al.

[11] 4,177,730

[45] Dec. 11, 1979

[54] METHOD AND APPARATUS FOR WEB PRINTING

[75] Inventors: Louis Schriber; Robert E. Stephens; John F. Blaha, all of Dayton, Ohio

[73] Assignee: Harris Corporation, Melbourne, Fla.

[21] Appl. No.: 738,751

[22] Filed: Nov. 4, 1976

[51] Int. Cl.[2] ..... B41F 5/08; B41F 13/14; B41F 29/00

[52] U.S. Cl. ..... 101/248; 101/DIG. 12; 101/219; 101/426; 101/226; 101/228; 283/1 A; 33/184.5

[58] Field of Search ..... 270/21; 33/184.5; 83/522, 343; 101/DIG. 12, 212, 216, 219, 248, 226-228, 426, 178, 181, 183; 283/1 A, 66 R

[56] References Cited

U.S. PATENT DOCUMENTS

| | | | |
|---|---|---|---|
| 2,539,068 | 1/1951 | Funk | 101/248 |
| 3,147,006 | 9/1964 | Fulk | 101/227 |
| 3,165,834 | 1/1965 | Benton | 33/184.5 |
| 3,314,322 | 4/1967 | Cutter, Jr. | 83/522 |
| 3,323,454 | 6/1967 | McFarland | 33/184.5 |
| 3,330,210 | 7/1967 | Hobbs et al. | 33/184.5 |
| 3,594,910 | 7/1971 | Ross | 101/216 |
| 3,613,252 | 10/1971 | Moos | 101/DIG. 12 |
| 3,621,582 | 11/1971 | Radencic | 101/DIG. 12 |
| 3,664,030 | 5/1973 | Pope, Jr. | 33/184.5 |
| 3,717,092 | 2/1973 | Crum | 101/248 |
| 3,750,568 | 8/1973 | Weisgerber | 101/248 |

FOREIGN PATENT DOCUMENTS

| | | | |
|---|---|---|---|
| 944692 | 12/1963 | United Kingdom | 101/248 |

*Primary Examiner*—William Pieprz
*Attorney, Agent, or Firm*—Biebel, French & Nauman

[57] ABSTRACT

A method and apparatus for makeready of a web press having an unwind apparatus for supporting a rolled web of material and having a plurality of rotatable members in spaced alignment defining a path for the web and arranged to perform operations on said web such as printing, perforating, numbering, punching or slitting, wherein the members are rotated in synchronism and are adjustable laterally and/or circumferentially with respect to the web path, is disclosed as comprising markings and scales establishing a reference position in the unwind apparatus for the rolled web and establishing separate side reference positions for each of said rotatable members which has a lateral adjustment with respect to the unwind reference position, and further markings and scales establishing a circumferential reference position for each of said rotatable members with respect to each other. A coordinate layout system for preparing a makeready job sheet is also provided with marks corresponding to the reference positions and scales in dimensions corresponding to said scale devices. A job sheet having dimensional settings is prepared with the layout system, using a representation of the desired product, whereby measurements are provided for lateral and circumferential adjustment of the adjustable rotatable members using their respective scale devices and the settings for the rotatable members can be accomplished with precision to minimizie their adjustment once the web is threaded through the press and a run is started.

9 Claims, 17 Drawing Figures

METHOD AND APPARATUS FOR WEB PRINTING

BACKGROUND OF THE INVENTION

This invention relates to web printing apparatus, for example, the type used in the manufacture of business forms. Such forms are, for the most part, printed from paper or light card stock web material, and may be left as a continuous web, sheeted, or folded, collected either single or collated in multiples, with lines of perforation between the successive forms to assist in separating them at the time of their use.

Equipment for manufacturing such forms is similar in some ways to other web printing presses, however, it includes additional devices for such operations as perforating, imprinting, numbering, partial or complete perforation either transversely or longitudinally of the web, slitting and either rewinding or zig-zag folding of the finished material. There may be more than one printing couple or tower, usually for offset printing. The printing may be on one or both sides of the web in one or more colors, and the various numbering, perforating and punching operations must be registered with the printed image or images on the web. Depending upon the size or complexity of the forms, they may be printed in any number of different layouts, from a single image to many multiples of an image for each printing impression.

The press operator, in setting up the press for a particular job, is confronted with a large number of setups and adjustments, which as is well known in the art, take substantial time in order to achieve proper registration of all the various operations required to complete the printing of a form. For example, the proper stock must be selected, and a roll of it mounted in the unwind apparatus of the press. This roll must be positioned to locate the web to follow a predetermined path best for alignment with the following operations in the press. The plate and blanket cylinders of the press must be aligned in order to locate the printed image(s) on the web, both laterally and longitudinally.

Longitudinal adjustment of course involves rotational adjustment of the plate and/or blanket cylinders. Then, depending on the needs of the job and the complexity of the form, the operator must set up further apparatus such as an imprinter, where a rubber or plastic type plate is mounted on a cylinder to add an imprint in a specified area of each form image; numbering units which must be set up and adjusted to print successively different numbers on one or more areas of the forms; and the various devices used for punching and perforating the web. In general, a line hole perforator is provided for at least one, and usually both, edges of each form. They must be mounted to produce the line holes in proper registration with the top and bottom of the printed image. Ordinarily a vertical perforator is provided to form perforations inboard of the line holes from the edge of the form, file hole punches may be added and registered to the image where needed, and cross perforators, or partial perforators may be set up and used, depending upon the job.

For instance, if the particular job on the press is to become part of a multi-sheet form, the cross perforations may not be added at this time, the web may be rewound, and one or more webs may be run with the same or similar printing in following runs, then the two or more rolls resulting from these runs may be moved to a collator and combined, probably along with interleaved carbon paper. The cross perforating operation is performed on the collator along with gluing or other operations to attach the several webs. In such case, zig-zag folding may also be accomplished at the end of the collator, or the combined webs can even be severed into individual forms and stacked for loading into boxes, etc.

While some efforts have been made in the printing portion of business forms presses to adopt image registration systems known in the printing press art, no effort has been made to provide a total registration system for the many different and optionally used mechanisms of a business forms press. Typical setup or makeready operations may require substantial time, in some cases time will be in excess of the time required to complete a run. For example, these machines can operate in excess of 1,000 feet per minute. Assuming a form of twelve inches in length, that speed equals 1,000 forms per minute, and thus a run of 20,000 forms requires only about twenty minutes. On the other hand, the makeready operation for such a job can require at least thirty to forty-five minutes, in many cases substantially more.

In addition, there is a trend toward combination of traditionally commercial printing work with business forms printing. Printing houses are seeking equipment which can do high quality multi-color work along with the flexibility to manufacture a wide variety of forms, inserts or attachments to forms, etc. Increasing business use of computerized forms for billing (including a return envelope in the form), advertising, and related functions, has also added to the complexity of the forms, and demand for greater quantities of forms.

In view of the foregoing, there is need to simplify the makeready operations for business forms presses, and without sacrificing in any way the necessary accuracy required to register the various operations of the press. Such simplification can result not only in a saving of makeready time, but also can result in substantial savings of material, since quicker, more accurate makeready minimizes the amount of waste required to run the web through the press and achieve final registration adjustments.

SUMMARY OF THE INVENTION

The present invention, therefore, provides a novel comprehensive system for machines to operate on web stock such as paper and like materials, especially for the purpose of producing business forms and similar products, in which makeready time actually required to set up the machine is reduced to a minimum. In actuality, most of the makeready adjustments can be set into the machine with this system even before it is necessary to thread the web through all the stations of the machine. In addition to a substantial saving in makeready time for the initial set up of the machine, it is also possible to realize a substantial saving in the web stock which otherwise might be wasted during a state of the art makeready process. With the system of this invention, only a relatively small amount of web stock need be run through the machine before it has been finally adjusted and ready to go into actual production of the particular product being made at that time.

In accordance with the invention, a business forms press, or like machine, is provided with various dials, scales, and indicating/adjusting mechanisms which are all related to common dimensional locations, both lateral (across the web) with respect to the various stations of the machine, and circumferentially (along the web) with respect to the rotary drive of the machine such as the main line shaft and the various gear boxes from which line shaft power is taken for transfer to the various machine operating stations.

The unwind station (rear) of the machine, at which the roll of web stock is supported, in other words the supply station of the machine, is provided with markings and mechanism which enable the web edge to be located with respect to a lateral zero reference position. In the case of the specific embodiment shown, this position is defined as four inches inward toward the center line of the machine from the inside of the gear side or driving side of a business forms press. Likewise, each of the various stations involving printing on the web, both conventional printing operations and numbering, etc., together with mechanisms for perforating, punching, and slitting, are all provided with adjustable mechanisms and precise indicators which relate the setting of such mechanisms to zero positions. These are the aforementioned lateral zero position, and a circumferential zero position which may be determined, for example, as the spacing between successive operations on a web by the main cross-perforation blade. The mechanisms and indicators are all related such that a composition operation may be performed at a composing table, and a record made to be used as a makeready instruction sheet to the press operator, whereby each adjusting mechanism, at each station, can be preset with precision. The various dials and scales are related to the actual location of the various operations on the web. This enables the operator to set up the machine quickly and accurately, after which it is necessary only to run a few lengths of stock through the machine to achieve the final adjustment.

Accordingly, the primary object of this invention is to provide a system in the form of a makeready process, and apparatus for carrying such process into operation, whereby a web machine such as a business forms press can be accurately preset to enable a machine operator to minimize the amount of trial and effort required during the makeready process for each job performed on the machine; to provide such a system wherein each station of the machine is provided with adjusting mechanisms, which enable the operator to establish quickly, relationships of the particular job of such mechanism with reference to common circumferential and lateral references; and to provide a novel system in which makeready instructions can readily be prepared in a composing room, and utilized by the machine operator to set up his machine accurately from such instructions, with a minimum trial and error adjustment.

Other objects and advantages of the present invention will be apparent from the following description, the accompanying drawings and the appended claims.

DESCRIPTION OF THE PREFERRED EMBODIMENT

Machine Organization

Figure 1:
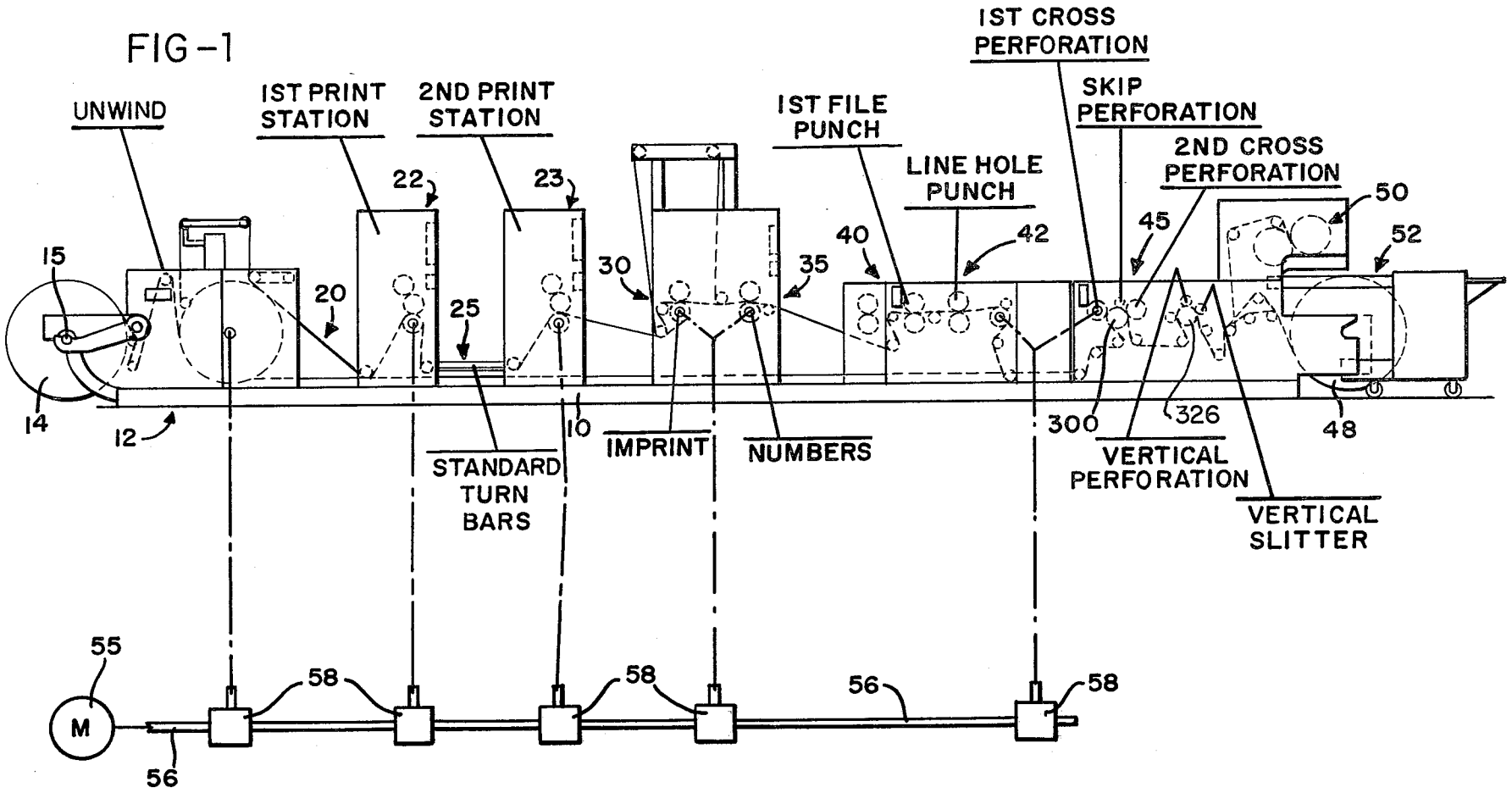
FIG. 1 is a general side view of a machine for printing and manufacturing business forms and similar items, showing the general arrangement of the various stations of the machine.

The machine shown in FIG. 1 comprises a base 10 supporting, in longitudinal alignment a number of stations at which various operations are formed on a web of paper or like material in order to print, mark, and perforate the web repeatedly. Such machines are per se well known, and details of them are shown, for example, in U.S. Pat. Nos. 3,249,316; 3,250,528; 3,369,436; 3,398,618; 3,592,133; 3,883,131; and 3,938,437. The drive system, including the line shaft, gears, etc., is shown schematically for purposes of clarity, it being understood that such drive is conventional and is arranged in order to operate the rotating and other moving parts at the various stations of the machine in exact synchronism, such that operations formed at any station are in register with operations performed at other stations.

Figure 6:
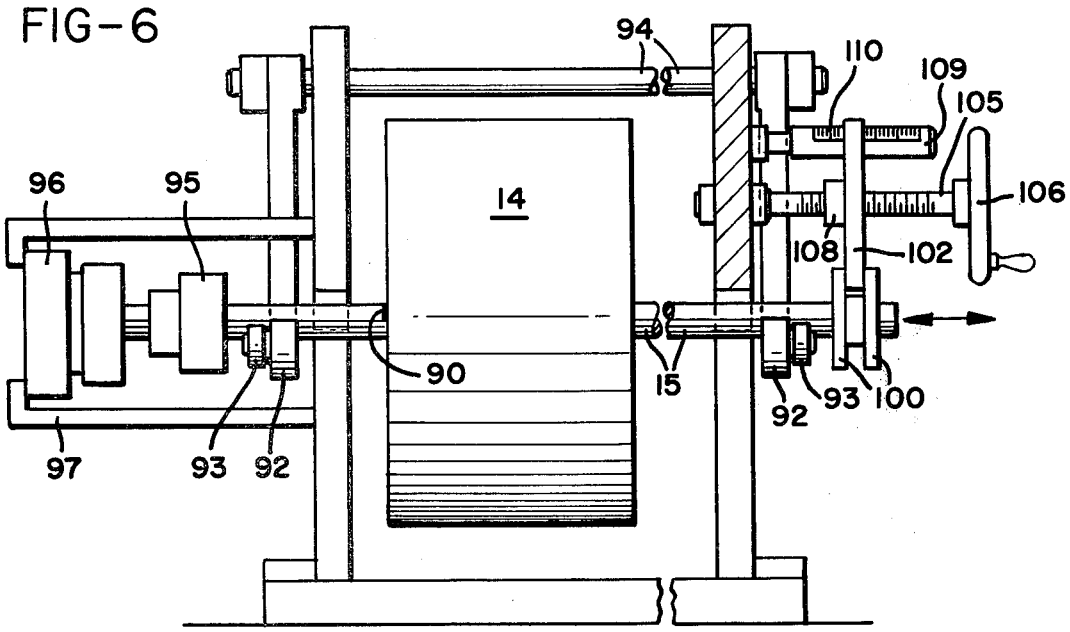
FIG. 6 is a view showing the unwind station of the machine, including the support provided for a supply roll of paper stock or the like, and the adjustment mechanism for setting the position of an edge of the web unwound from the roll in order to define the start of the path the web follows through the machine.

The unwind station 12 includes a support for the roll 14 from which the web is pulled, and also includes mechanism for assuring that the web is unrolled at synchronous speed and as nearly as possible under constant tension. Suitable devices for this purpose are explained in detail in U.S. Pat. No. 3,249,316. Details of the mounting and adjustment of the shaft 15 supporting the roll 14 are shown in FIG. 6, and described later in detail.

After the unwind station 12, understanding that the web 20 is unwound and progresses from left to right as viewed in FIG. 1, there are first and second print stations 22 and 23 which include conventional printing cylinders, etc., for printing repetitively on the web by means of offset, letterpress, flexographic, or gravure printing, as may be desired. It is understood that in some instances there may be only one print station. In the embodiment shown, offset printing equipment is generally illustrated, and two print stations are shown with turning bars 25 therebetween. The web can optionally be threaded around the turn bars in order to reverse the surface of the web presented to the second print station 23, such an arrangement sometimes being referred to as backprinting. The print stations can, if desired, print in different colors, and obviously additional print stations can be provided if desired.

Figure 9:
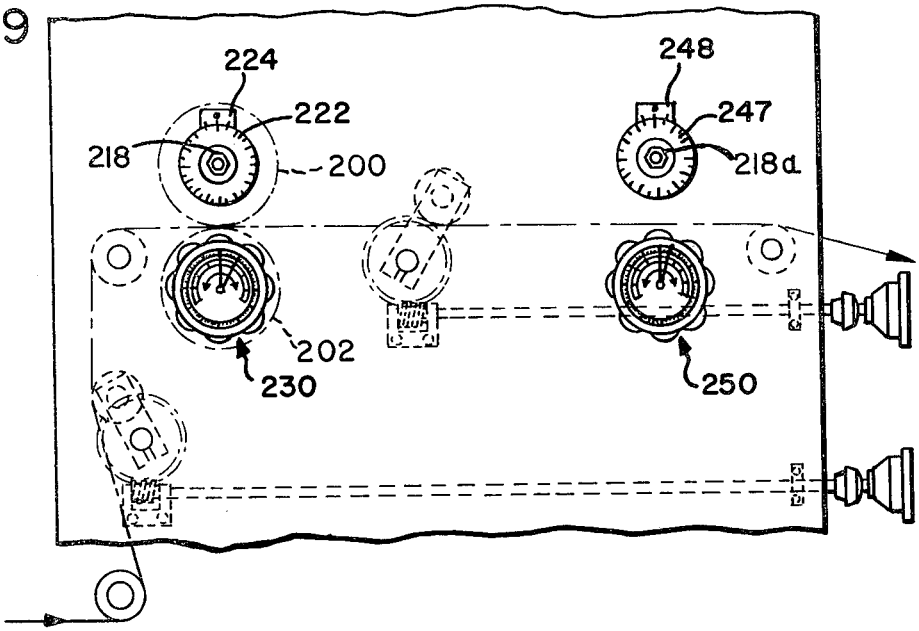
FIG. 9 shows web compensators and other adjusting devices in the imprinting and numbering stations.
Figure 10:
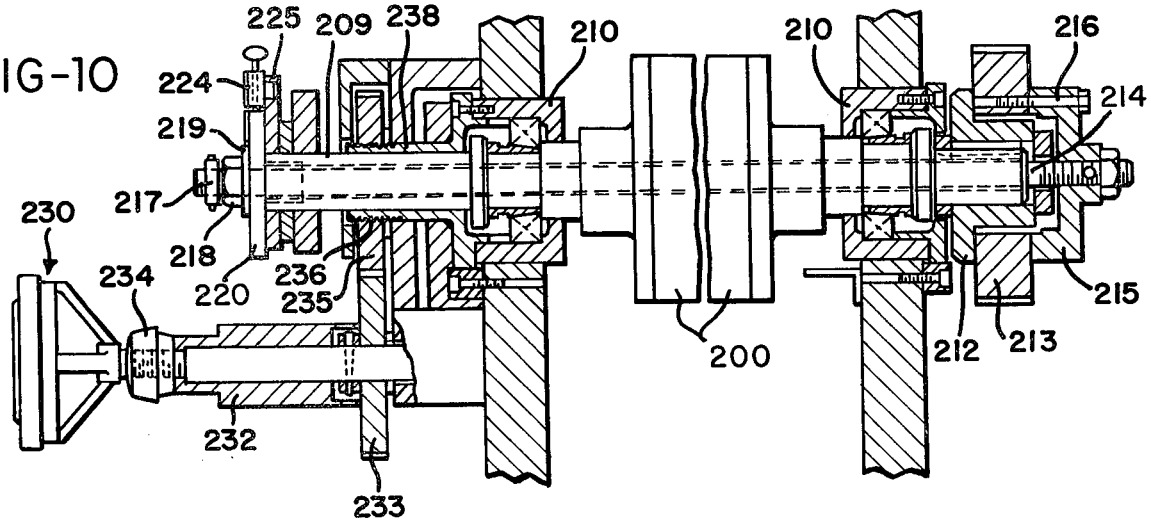
FIG. 10 shows details of registering adjustment for the imprinting station.
Figure 11:
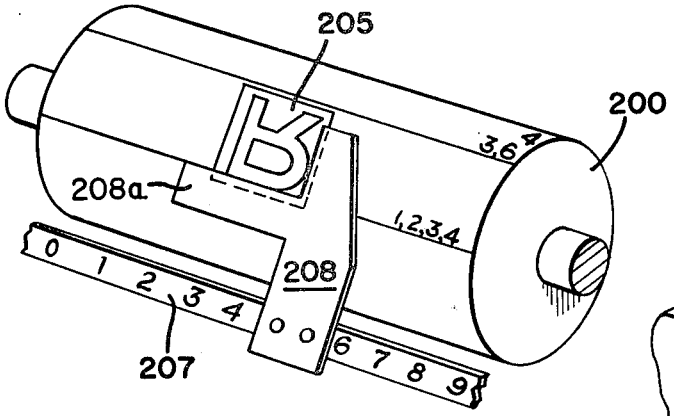
FIG. 11 illustrates the mechanism for locating the area of attachment of an imprint plate or device on the appropriate cylinder of the imprint station.

Following the second print station, there is a station for performing an operation known in the business forms printing art as "imprinting". This station is shown generally at 30, and further details are shown in FIGS. 9–11, as explained hereafter. In general, a repetitive printing operation is performed on the web at station 30 by one or more flexible letterpress type plates, sometimes referred to as "patches", which are secured to the surface of a supporting cylinder in predetermined registered locations. The printing operation is generally similar to letterpress printing, with ink appropriately being applied to the raised image areas of the imprint patches.

Figure 12:
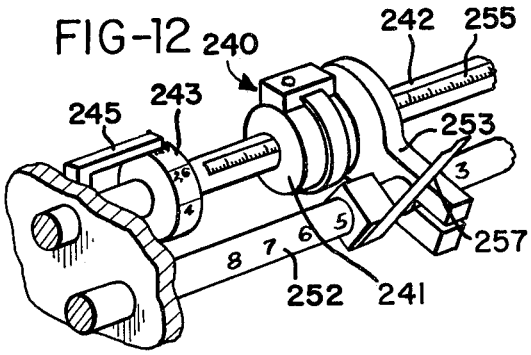
FIG. 12 shows the mechanism for determining and adjusting the location of the numbering machines at the numbering station.

Following the imprint station, the web passes to a numbering station 35; see FIGS. 9 and 12. Here, one or more numbering machines are mounted to print different number combinations on the web. The numbering machines are per se known, and function generally to change the number printed on successive portions of the web, either in straight numerical progression, reverse progression, or in some progression where certain numbers are skipped, depending upon the size and complexity of the particular job, and the number of these machines being used.

Figure 13:
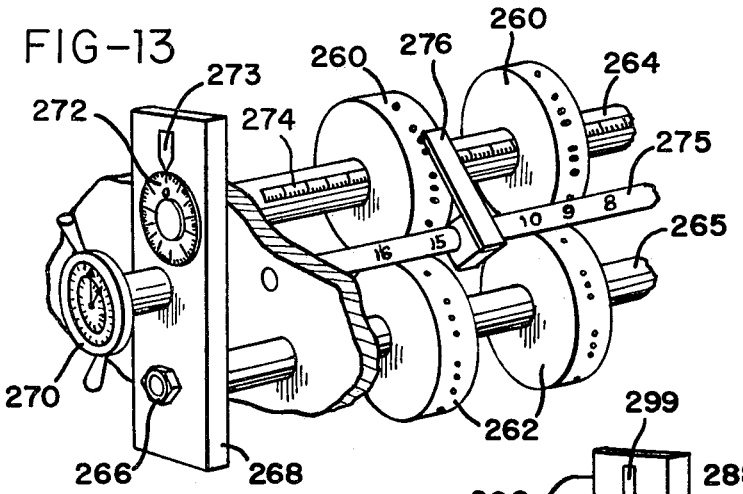
FIG. 13 shows the mechanism for registering the one or more punches and dies used at the file punch station.

After numbering, the web passes to the so-called file punch station 40, where one or more rotary punch and die mechanisms may operate on the web, as shown in FIG. 13, to form so-called "file holes" in areas of the web. These holes are sometimes provided in business forms as a convenience to the user, being intended to receive posts, brads, or other retainers to hold the separated sheet or form in a file. The holes may be located at any convenient point within the area of the form, depending upon the needs of the customer and his filing equipment.

After the file punch station, the web is threaded through a line hole punch station 42 (see also FIG. 14), wherein appropriate rotary punches and dies can form so called "line holes", usually in marginal regions of the forms. These holes are needed particularly in forms intended for use in autographic registers, and in multipart forms made up of several webs, wherein the web prepared in this machine may subsequently be combined with similar webs in a collating machine.

Figure 16:
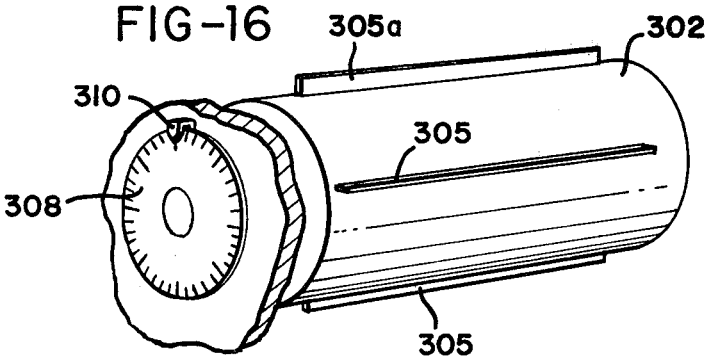
FIG. 16 shows the mechanism for aligning and registering the blades of the cross perforation device.

Following the line hole station 42, there is a perforating station 45, which may incorporate several different types of perforators and/or slitter devices for forming partition lines of severance both crosswise and lengthwise of the web. Some of these lines are indicated in the typical form shown in FIG. 2, and described hereafter. The first part of the perforating station may incorporate a cylinder containing cross perforator blades, such as shown in FIG. 16, followed by small slitter wheels arranged to contact the web intermittently, these usually being known as skip perforators, then followed possibly by a second cross perforator cylinder, and subsequently followed by one or more vertical perforators which perform lengthwise discontinuous slits or cuts in the webs, and then followed by slitter wheels which make continuous lengthwise slits in the web.

At this station operations on the web are essentially complete except for determining the form in which the web is taken from the machine. If the finished web is part of a multilayered form, then it will be rewound onto a take up roll 48, and can be carried away on any convenient device to a collating machine or other mechanism for further operations in which the finished web is unrolled from the roll 48. On the other hand, if the particular job is concerned with a single layer form, or with some other printed product such as consecutively numbered tickets, cards, or the like, the web may optionally be supplied to a zig-zag folder which comprises the folding cylinders 50 and delivery table 52. Details of a typical folder are disclosed in U.S. Pat. No. 3,250,528. It is also possible to sever the web into individual sheets at this station, as is well known in the art.

The various stations are driven at the same speed from a motor 55 via line shaft 56 and gear boxes 58. Clutches (not shown) are conventionally connected between the gear boxes and the various stations to allow for selective connection of power to each of them.

From the foregoing it will be appreciated that a number of the operations at the different stations broadly described are optional, depending on the particular need of the job, thus the machine may be used in many different combinations, with some stations operative, and others not functioning, depending upon the types of printing required (if any) and the types and locations of punched holes and various perforations and slits in the particular job requirement. A typical machine, such as that shown, is capable of multicolor printing, and/or printing on both sides of the web together with printing of numbers in desired progression on each image area of the web, along with the necessary punched holes and/or perforations, all in a continuous stream with the web operating at speeds up to the order of 1200 feet per minute. It is thus necessary to provide for quick and accurate adjustment of the various mechanisms at the different stations, when these mechanisms are required to operate according to a particular job specification.

Typical Form Product

Figure 2:
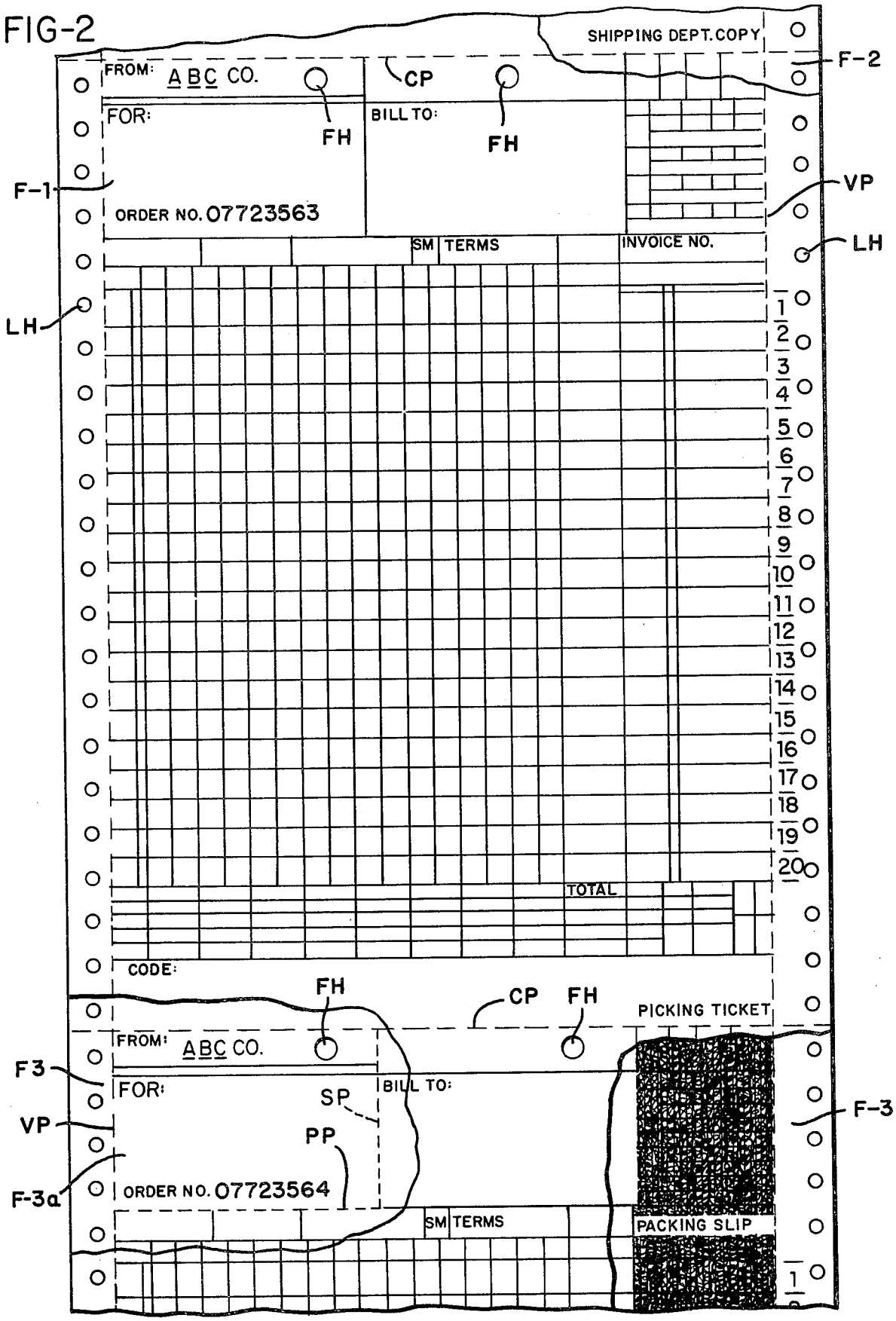
FIG. 2 is a plan view, with parts broken away to show other underlying parts, of a typical multipart business form the sheets of which are products of the machine.

FIG. 2 shows a typical multipart business form, the individual parts of which can be printed on the machine shown in FIG. 1. The material used may be different colors of paper stock, and may be either of the "no carbon" type, or the form parts may have sheets of disposable carbon paper (not shown) interleaved between them. The assembly of the separate parts of the form and the carbon paper (if used) can be accomplished on a typical collating machine such as shown, for example, in U.S. Pat. No. 3,303,083.

The form shown in FIG. 2 comprises three parts, the top or original F1, which may be printed for example on white paper; the first copy F2, which might be printed on a web of colored paper, and typically might be an instruction copy for a shipping department; and F3, the third part, which may be printed on yet a different color of paper, and may typically be a packing slip. In the form shown, the identification of the addressee on form F3 may be a removable ticket F3a which can be used for a shipping label, being separated from the packing slip F3 when the package to which the form pertains is shipped to a customer.

The continuous forms are separated from each other by cross perforation lines CP, the forms are provided with file holes FH for convenience in filing some or all of the parts of the form according to the preference of the user, and the marginal portions have line holes LH, which may be used to feed the separate parts of the form through the collating apparatus which assembles them, and also may be used to feed the assembled multi-part form through various devices such as computer printers, autographic registers, etc.

The marginal parts of the forms are separated from the body of the form by vertical perforations VP, such that these marginal parts may be removed from the form in its final use. The shipping ticket F3a is outlined on form F3 by partial perforation lines SP and PP, which intersect the cross perforation line CP, and the vertical separation line VP, to define the ticket which may be removed from the form F3. Each form is provided with a unique order number, corresponding on all three parts of the form, and one copy of the form, for example part F3, may be imprinted or overprinted to obliterate information which appears on the other parts, but is unimportant or undesired on one of the form copies. Such imprinting is indicated on form F3 by the darkened mottled area. On any of the parts of the form, areas such as particular columns, particular lettering or designs, etc., may be printed in different colors, either for the purpose of design/appearance, or in order to set out some particular column of information by reason of its importance on the final form.

Job Preparation—General

To reduce time and effort needed in performing the job preparations prior to printing, and to permit an effective reduction in the total job makeready time, the system of the invention provides for accurately reading and recording the composition to be printed. A typical record is shown in Appendix A. From it the pressman, using specially designed hardware and coordinated register scales and dials at the various press stations, can efficiently prepare his press in a minimum amount of time.

In the preferred embodiment all readings and press settings are made from a manufactured established "0" position, both circumferentially and laterally across the web. For example, circumferential registration is related to the main blade of the cross perforating cylinder (station 45) as the "0" position. This is indicated through a dial attached to the cylinder and a pointer mounted on the frame. Those presses not having a folding cross perforator can use the line hole reel position as a "0" reference.

Lateral registration "0" position is established by locating a roll 14 on the unwind shaft 15, positioned such that the edge of the maximum printed image for the press capacity is located four inches from the inside of the frame on the gear side of the press, i.e., the side opposite that shown in FIG. 1. Lateral dimensions are measured from the gear side of the press. Circumferential dimensions may be read with reference to the main blade of the cross perforating cylinder.

Dials and scales are calibrated to obtain an accuracy of ±0.015 inches. Circumferential and lateral position at the various stations can be adjusted within 0.001 inches. Press functions included in the system are lateral register of the offset plate cylinder, numbering machines, imprint cylinder, file and marginal punch reels, slitters and vertical perforating wheels. Turn recording dial knobs are used on all units for this function. Circumferential register is accomplished by the use of position dials on the blanket cylinder, numbering shaft, imprint cylinder, file punch shafts and innercross perforating cylinders. Turn recording dial knobs are also used on all running compensators. Details of these adjustments and their indicators are later described in detail.

Layout Table

Figure 3:
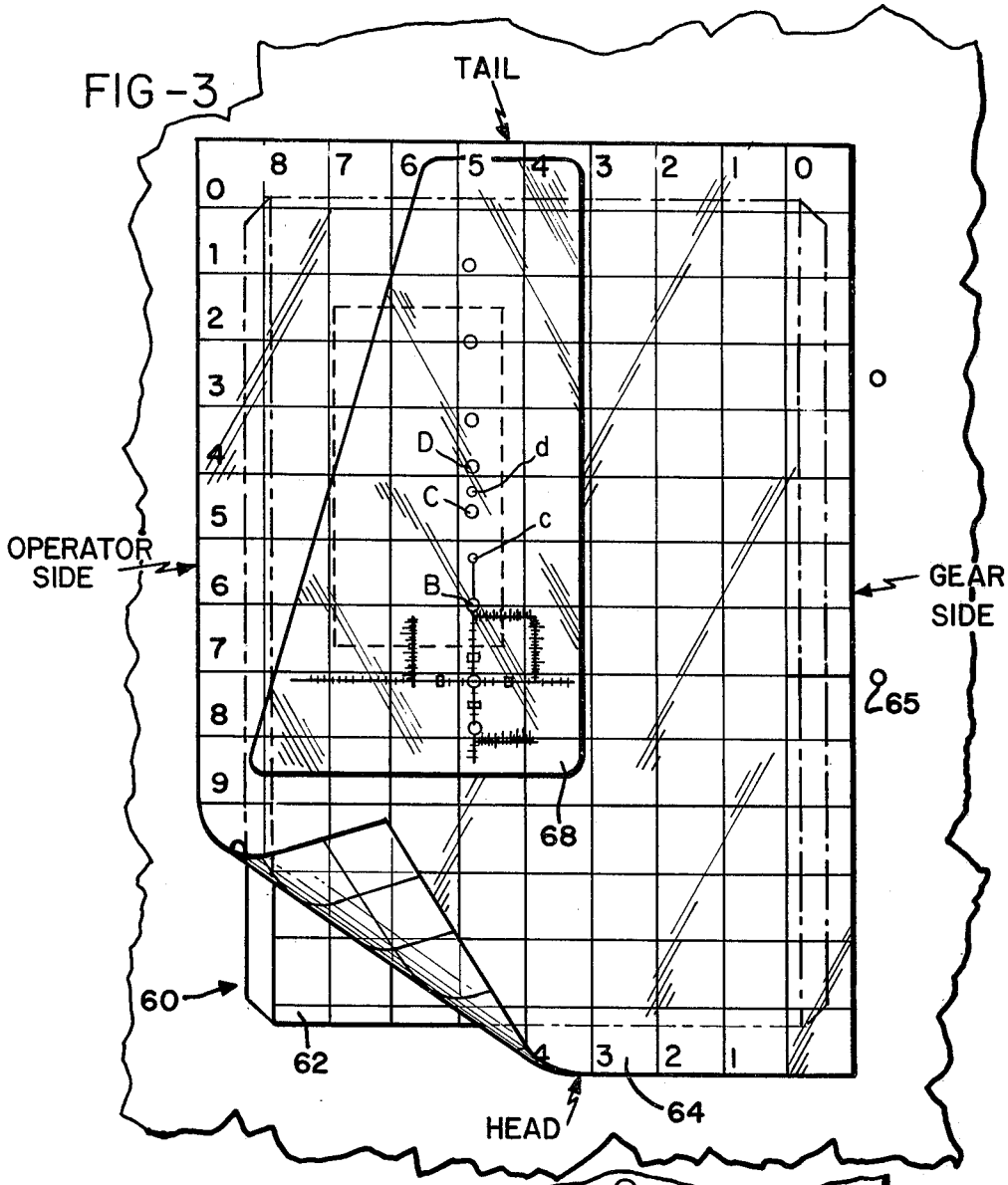
FIGS. 3 and 4 show details of tools for preparing a typical instruction sheet used in alignment of the various adjustable mechanisms in the different stations of the machine, according to the needs of a particular job.

The system includes a special composing or layout table from which entries are determined as to coordinate measurements which relate to the lateral (across) and circumferential (around) positioning in the various sections of the apparatus. The table includes a smooth flat surface 60 having mounted or formed thereon a lower grid template 62, over which various types of copy can be located in accordance with the desired location of text or other markings or holes on that copy relative to the entire job. A flexible transparent overlay sheet 64 is provided, having the same grid work pattern as is formed on the grid template 62, and the overlay sheet is hinged or otherwise attached to the table, such that the grid patterns precisely correspond when the overlay sheet is properly positioned, as shown in FIG. 3. If desired, the table surface 60 may also incorporate sockets 65 to receive pins (not shown) for a pin register system which may be used in registration of the plates of the printing unit or units.

The entire area of the grid template 62 and of the overlay 64 represents the maximum available area for processing the web at any one station, as determined by the press size. Certain conventions have been adopted for convenience in use, and these are also of assistance in explaining the system. Thus, as noted on FIG. 3, the top of the supporting grid template 62, and the top of the overlay 64, correspond to the tail of a printing plate. The bottom of FIG. 3 represents the head of the printing plate, the part that passes first through the nip with the blanket cylinder. The righthand edge corresponds to the gear side of the press. The left side of FIG. 3 represents the operator side of the press.

Figure 4:
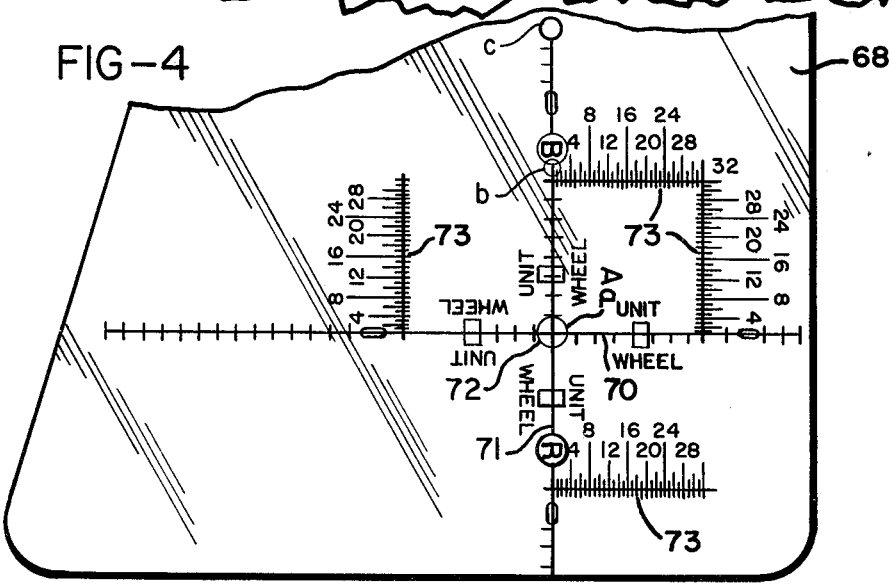

The grids on template 62 and overlay 64 are laid out in whatever is the useful measurement for the composer. For example, the grids can be one-inch squares, or squares of an appropriate metric measurement such as one centimeter. A grid cursor is provided as shown in FIGS. 3 and 4, comprising a transparent relatively rigid sheet, such as an acrylic plastic, indicated by the general reference numeral 68, and having thereon various scales and guides (circles and rectangles) such as shown particularly in FIG. 4. These include "across" and "around" coordinate lines 70 and 71 which intersect, at a target 72, the grid work of the overlay 64, and the scales 73 which are provided with fractional measurements of the basic square of the grid, shown by way of example as graduations equal to 1/32 of an inch. Also, the cursor is provided with a number of circles along line 71, one of these (Aa) being at the intersection of the coordinate lines 70 and 71. The other circles are arranged, in accordance with commonly used file hole numbering and spacing systems. For example (FIGS. 3 and 4) the larger circles A, B,—R correspond to punch and die locations on the file punch (and die) reels, shown in FIG. 13, for printing forms 2-around and 4-around; the smaller circles a, b, . . . correspond to punch and die locations for printing 3-around and 6-around form patterns. The rectangles labelled "unit wheel" correspond to the locations, offset from the target, of the units digit wheel of numbering machines. The orientation of the label corresponds to the appearance of the number digits; i.e., if the digits are upright, the rectangle on line 70 to the right of the target is used, and if the digits are inverted the rectangle on line 70 to the left of the target is used. Further explanation of the use of these cursor features is included hereafter.

Figure 5:
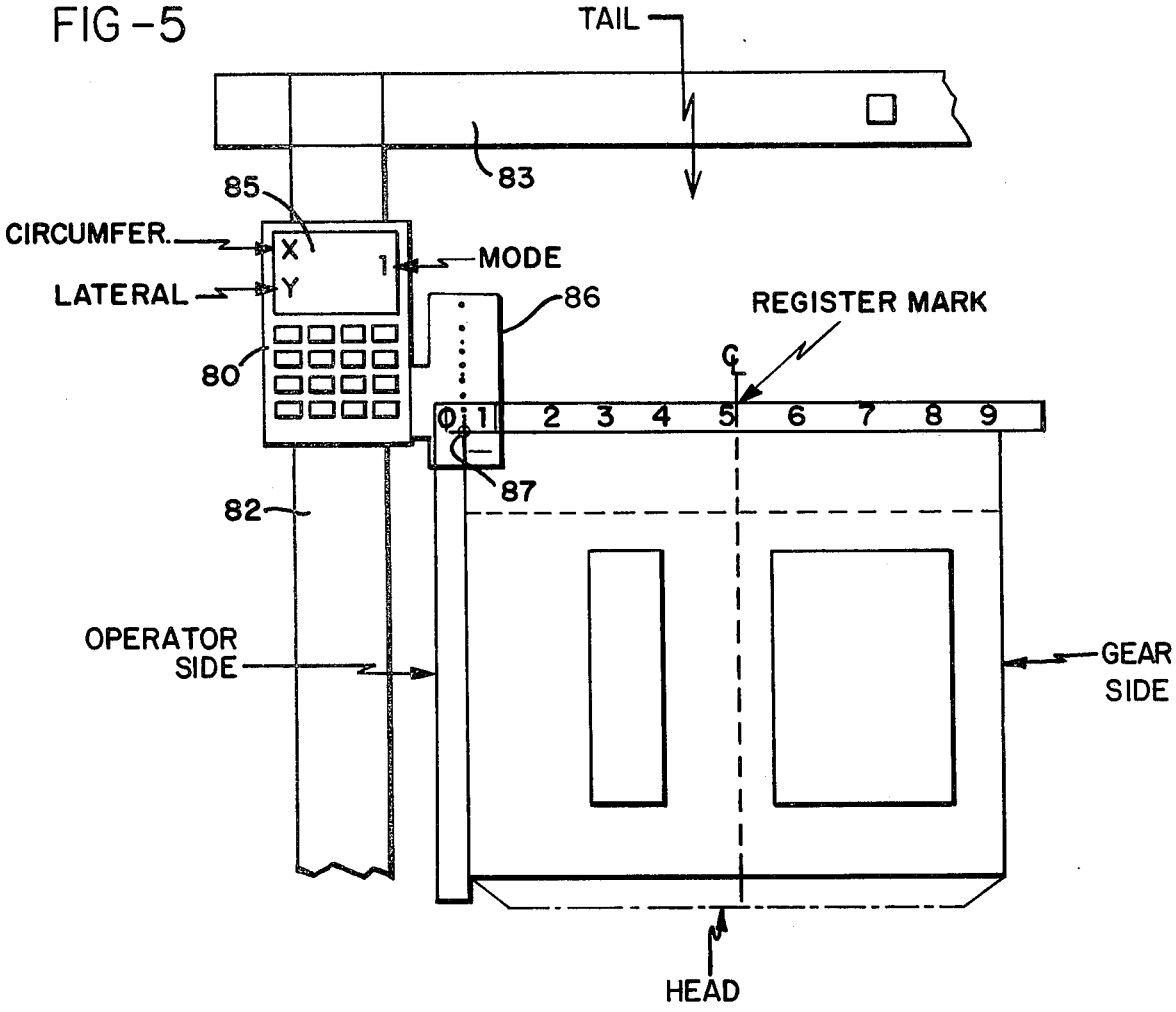
FIG. 5 is a view of another mechanism which can be used to prepare the instruction sheet.

Referring to FIG. 5, there is shown another form of composition table utilizing a commercially available drafting aid device known as a Digitrac reader, which is available from Melco Industries Incorporated, 7100 Broadway, Denver, Colorado. This device includes a digital readout member, electronically operated, supported in the body 80 which is mounted to move on the vertical track 82, and that track in turn is mounted to move horizontally on the horizontal track 83. The body 80 includes electronic devices for displaying both the x and y motion of body with respect to the two tracks, these being displayed on a readout panel 85 in the form of electronic digital display devices which show in numerical form both the x (across) and y (around) movement of the body in suitable units with respect to a preselected zero point.

Attached to body 80 is a transparent cursor number 86 which includes a center point or target shown as a circle 87 crossed by vertical and horizontal center lines at 87. This represents the readout point of the device, and can be used in known fashion with the Digitrac mechanism to set the initial position and readout at zero, in which position the device is shown in FIG. 5 with the cursor center lines located at the tail and operator side corner of the composition area. The cursor 86 also includes the circle and rectangle guides, as on cursor 68, however, the graduated scales are not needed because of the nature of the Digitrac readout.

Once the unit has been properly set to zero, in accordance with known practice with these devices, the recording of makeready information proceeds using the layout table and the Digitrac readout mechanism. The information sheet (Appendix A) is thus prepared for the use of the machine operators to set up the job.

Unwind Station

Referring to FIG. 6, the shaft 15 is a removable shaft known in the art as an "air" shaft, which includes mechanism, not shown, operable by compressed air to expand and contract within the core of the supply roll 14. The shaft 15 is provided with an index mark 90, which provides a reference position for the edge of the roll with respect to the gear side of the machine. Shaft 15 is, in operating position, supported by a pair of swinging arms 92, resting in rotatable roller bearings 93 carried by those arms, and the arms 92 in turn are pivotally mounted to the side frames of the machine, being supported for example on the cross shaft 94.

It will be seen from FIGS. 1 and 6 that when the arms 92 are lowered a roll 14 can be moved into place, and the shaft 15 may already be inserted in the core of the roll, with the mark 90 properly aligned with the edge of the roll which is nearest to the gear side of the machine. Shaft 15 is provided with a coupling 95 through which it attaches to a brake mechanism 96 supported on an extension 97 of the gear side frame of the machine. When the shaft and roll are properly in position, with the arms 92 raised to the operating location, the coupling 95 is engaged and brake 96 can be operated to retard unwinding of the web from the supply roll 14.

Shaft 15, and the roll 14 with it, are movable laterally between the side frames of the machine. This motion can be accomplished by sliding the shaft on the bearings 93 which support it, and suitable mechanism, such as a spline connection, can be incorporated in the coupling 95 in order to maintain a proper connection with the brake 96. On the end of shaft 15 beyond the arm 92 on the operator side of the machine, a pair of flanges 100 are formed, and between these flanges extends an arm 102 which is part of a lead screw mechanism, the screw 105 being rotatably supported in the side frame, and rotatable by means of a hand wheel 106. A nut 108 moves along the lead screw, and is secured to the arm 102.

A portion of arm 102 also extends upward adjacent a rod 109 which carries a scale 110. This scale is mounted and calibrated to indicate the location of the supply roll and shaft 15 with respect to the "across" reference position, which as mentioned before may be a suitable dimension from the gear side frame. Thus, with the lead screw mechanism set to zero position, when the shaft 15 and roll 14 are moved into operating location, the edge of the supply roll 14 closest to the gear side is at the "across" zero reference position. The roll may then be shifted in accordance with the entry of the instruction sheet so as to locate the edge of the roll as desired for that particular job. For example, the job might call for ¼ inch trim along the web, in which case the setting would be—8/32 inch.

Printing Station

Figure 7:
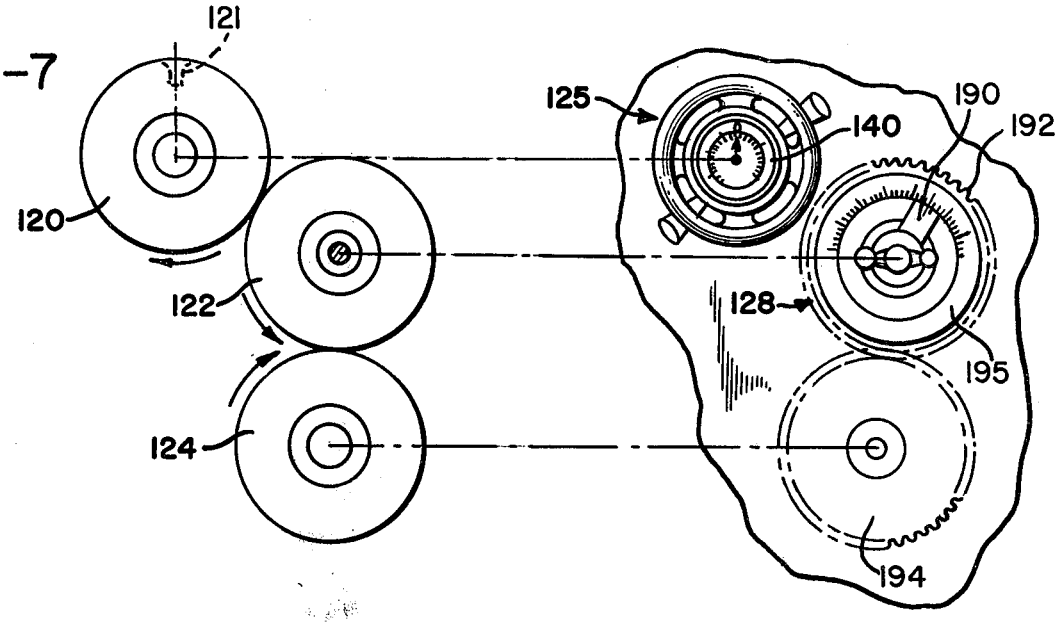
FIG. 7 is a view illustrating the register adjustment mechanisms incorporated in the printing stations of the machine.
Figure 8:
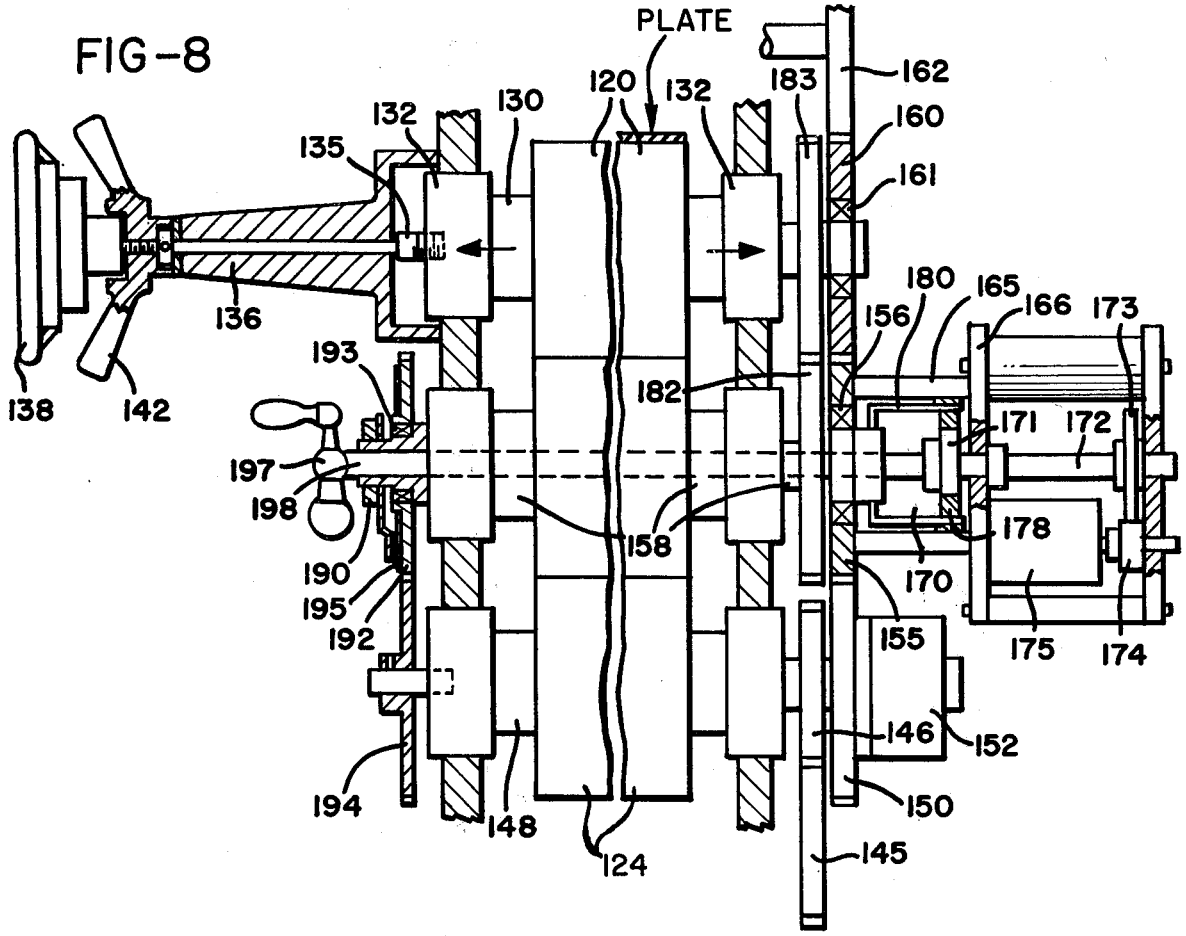
FIG. 8 illustrates the mechanism for lateral and circumferential register adjustment in the printing stations.

FIGS. 7 and 8 show schematically the principal elements of one of the print stations, in this particular instance, being exemplified by an offset printing couple. The plate cylinder is indicated at 120, the blanket cylinder at 122, and the impression cylinder at 124. The gap where the plate attachment is made is shown at 121. Attached to the shaft of the plate cylinder 120 is an adjusting and indicating mechanism 125 which is used, as later explained, to adjust and to display the lateral (across) positioning of the plate cylinder, and therefore the lateral position with respect to the running web, of the plate mounted on that cylinder. This mechanism projects from the side frame of the machine at the operators' side, and adjacent to it, aligned with the access of the shaft of the blanket cylinder, is adjusting and indicating mechanism 128 for the circumferential (around) adjustment of the image printed at this printing station, whereby the printed image is adjusted and located lengthwise of the web.

FIG. 8 shows in schematic form the general layout of the three cylinders of the printing couple, their mounting, their drive and the adjusting and indicating mechanisms as above described. For ease of understanding the cylinders are shown in vertically stacked relation, as opposed to the actual somewhat offset positioning shown in FIGS. 1 and 7. The plate cylinder 120 has its supporting shaft 130 mounted in bearings 132 which are in turn supported in the side frames of the printing station. The shaft 130, and the plate cylinder on it, is adjustable sideways with respect to the printing station through a connection with an adjusting screw 135 which extends outwardly on the operator side of the machine, supported within an extended tubular housing 136. An adjusting wheel 138 is connected to the end of the adjustment screw 135 such that rotation of the hand wheel 138 will produce a slight but predetermined movement of the plate cylinder 120 sideways of the print station. A dial indicator 140 (FIG. 7) is incorporated in the hand wheel and connected to the adjusting screw 135 in such fashion that movement of the pointer of the dial with respect to its scale indicates the location of the plate cylinder with respect to a starting position, which is in turn indicated by zero on the dial. The second handle 142 is threaded around the outer end of the adjusting screw 135, behind the hand wheel and dial mechanism, and operates when rotated to lock the adjustment screw 135 in any predetermined adjusted position.

Thus, with the side of the plate located to the gear side edge of the plate cylinder 120 in any suitable fashion, either by center line reference or pin register, as later explained, the operator may rotate the handle 142 to unlock the adjustment screw 135, and then rotate the hand wheel 138 until indicator shows the adjustment indicated on the job sheet for this particular printing function, or for final lateral positioning as required.

Power for the printing station is derived from one of the gear boxes 58 (FIG. 1) and the output gear of the appropriate gear box is coupled to an idler gear 145, which in turn meshes with a drive gear 146 fastened to the shaft 148 of the impression cylinder 124. The impression cylinder thus rotates at a speed related to line shaft speed. A further gear 150 surrounds the impression cylinder shaft 148 on the drive side of the machine, being supported thereon by bearings which are not shown. This gear can be coupled to the shaft 148, and hence to the power input, through a selectively operable clutch 152 which has its input attached to shaft 148 and its output attached to gear 150. The power train from gear 150 includes a gear 155 which is rotatably mounted in bearings 156 around the shaft 158 of the blanket cylinder 122, and a further gear 160 which is rotatably mounted in bearings 161 on an extension of the plate cylinder shaft 130. The gear 160 meshes with the first gear 162 of a drive train that supplies power to the inking mechanism of the print station. Such mechanism is conventional and is not shown here.

Power is transmitted to rotate the blanket cylinder and plate cylinder through a differential which provides for circumferential adjusting. A first cage 165 is attached to the gear 155, rotating with it, and also at its outer end to a second cage 166 (also rotatable with gear 155) which contains the input to a differential unit 170. A sun gear 171 of the differential is attached to a shaft 172, rotatable centrally of cage 166, and on shaft 172 there is a gear 173 which provides an adjustment input.

A gear 174 on the output of a stepping motor 175 meshes with gear 173 to input fractional rotational movements to shaft 172, as may be necessary to advance or retract the sun gear 171 with respect to the planet 178, which in turn meshes with the ring gear of the differential. The internal gear may be part of a cup like member 180 which is surrounded by the first cage 165, and which is fastened to an extension of the blanket cylinder shaft 158.

Also fastened to that shaft is a further gear 182 which in turn meshes with a gear 183 fastened to shaft 130 of the plate cylinder, thus assuring that the plate and blanket cylinders rotate in synchronism.

At the other end, or operator side, of blanket cylinder shaft 158 there is fastened a pointer or vernier indicator 190 which rotates with the blanket cylinder. Behind this pointer there is a gear 192 which is supported in bearing 193 around the end of shaft 158, and gear 192 meshes with a gear 194 driven from the impression cylinder shaft 148. On the face of gear 192 there is a graduated dial 195 which cooperates with the pointer 190 to indicate the circumferential displacement, if any, of the blanket cylinder with respect to the impression cylinder. This of course, also refers to the position of the plate cylinder since it is synchronized to rotate with, but opposite to, the blanket cylinder via gears 182 and 183.

A hand crank 197 is connected to a shaft 198 which extends through the blanket cylinder shaft 158, freely rotatable therein, and connected at its other end to the gear member 171 of the differential. Thus, the differential may be adjusted either through operation of the stepping motor 175 or through rotation of the adjustment crank 197. In either case, the resulting circumferential displacement of the printing couple is indicated by the pointer 190 and dial 195. This mechanism rotates with the cylinders of the print station in operation, therefore it is covered by a suitable door (not shown) when the machine is operated.

Assuming that the pointer index is aligned with the zero position on scale 195, this indicates the center of the gap 121 is at the zero reference (around) position from which circumferential adjustments are made. Rotation of the member 171, either by hand or through the stepping motor 175, will operate the differential to cause relative movement of shaft 158 with respect to the power input via clutch 152. For example, the operator can turn crank 197 while observing the pointer and scale, until he obtains an "around" setting corresponding to the reading instructed on the job sheet. During operation of the machine, should further circumferential adjustment be required, the operator may cause the stepping motor to advance or retract through an appropriate control (not shown) thereby adjusting the position of the gears of the differential while the machine is in operation.

If the machine is provided with a second print station, such as shown at 23 in FIG. 1, then the controls and indicators as described above, will be duplicated on the second print station. It is understood, from previous explanation, that the turn bars 25 may or may not have the web threaded through them to print the reverse side of the web at the second print station.

Imprint And Numbering Station

The web proceeds through the imprint and numbering station, the first in the sequence being the imprint section 30, where the web is threaded between the imprint cylinder 200 and the imprint impression cylinder 202, as shown in FIG. 9. Before entering the nip between these cylinders, the web passes over conventional web length compensating units (not numbered), which are used to adjust for the difference in web path, particularly around rolls, which is encountered with different thickness of web stock. At the imprint station 30, the cylinder 200 is a smooth surfaced cylinder which may be provided with a number of transverse guide lines, these being shown generally in FIG. 11. These lines, as later explained, provide part of the system for locating the imprinting patch or plate 205. The patch 205 may be used to print various signs, letters, numerals, or overprint areas, such as the mottled area shown on the third web F3 in FIG. 2. Such overprinting may be used, for example, when it is desired that certain information not appear, at least not intelligibly, on one of the copies of the form. The pitch 205 is in the nature of a flexible printing plate, (or letterpress plate), which covers a partial area of the form, and as is generally recognized, the quality of printing from such a plate may not be of as high quality as can be performed at the preceding print stations. The patch or form 205 is inked through standard inking mechanism (not shown). The patch (or patches) is held to the cylinder by an adhesive, and it is difficult to adjust the patch position once it is mounted.

Two adjustment devices are provided for the purpose of locating the patch, and the print that it makes, within the system. First of all, the transverse lines on the cylinder 200 may be appropriately numbered, such as indicated, to provide an index to the location, with reference to the circumferential zero position of the cylinder. In addition, the cylinder 200 is adjustable circumferentially, and laterally with respect to the predetermined "zero" reference positions. Mechanisms are provided for indicating this lateral movement and circumferential displacement of the surface of cylinder 200.

Adjacent to the cylinder 200, parallel to its surface, there is a transverse guide bar 207 which is provided with a scale on its surface. Slidable along this guide bar is a patch locator 208 which is hinged in its mounting to swing toward and away from the cylinder 200, being withdrawn from the cylinder when not in use. An arm 208A extends sideways from locater 208, parallel to the transverse lines on the cylinder surface. It thus provides an L-shaped locating mechanism within which the patch 205 may be aligned both vertically and horizontally, and the scale 207 provides a direct reading reference for location of the right hand edge of the patch 205, as is viewed in FIG. 11.

The shaft 209 of the roll 200 is hollow, and it is supported for rotation within bearing blocks 210 (FIG. 10) which are movable sideways within supporting openings in the side frames of the machine, as shown in FIG. 10. The end of the imprint cylinder shaft at the gear side of the machine has a collar 212 keyed to it, and around this collar there is received a drive gear 213 which is driven through suitable gear train (not shown) from the appropriate gear box 58 on the line shaft (FIG. 1). Internally of the imprint cylinder shaft there is a smaller shaft 214 which is pinned at the gear side end to a cup 215, and this cup is provided with a bolt 216 extending an appropriate aperture in gear 213. Thus the internal shaft 215 and the gear 213, and therefore the line shaft, are always in phase. At the operator side of the machine the shaft 214 is fitted with a cross pin stop 217, and behind it a clamping nut 218 which can be tightened against a washer 219 and an indicator disc 220, thereby drawing the cup 215 against gear 213, and clamping that gear against the collar 212 to provide an adjustable clutch connection between the gear 215 and the imprint cylinder 200.

On the face of the disc 220 there is provided a circular scale 222, which may be marked in suitable increments, for example one thirty-second of an inch, and cooperating with that scale there is a pointer or a vernier indicator 224 that is supported on an arm 225 fastened to the forward extending part of the imprint cylinder shaft 209, such that the arm 225 rotates with that shaft. Thus, the circular dial or scale 222 provides an indication of the zero position of the imprint cylinder, and is always in phase with the line shaft drive, whereas the pointer or vernier 224 moves with the imprint cylinder when it is unclutched from the drive by backing off the clamping nut 218. The indicator dial and the vernier thus cooperate to indicate circumferential displacement of the surface of the imprint cylinder with respect to the drive mechanism. A zero indication demonstrates that the line marks 1, 2, 3, 4 coincides with the "around" zero reference of the main cross-perforation blade at station 45, and the gap 121 (FIG. 7) when set at zero.

Therefore, the patch locator 208 and scale 207, cooperating with tthe transverse lines which are located in predetermined positions around the surface of cylinder 200, provide a means for locating the patch 205 in coordinates with respect to both "across" zero and circumferential (around) zero within the system. In addition, the ability to rotate the imprint cylinder 200 with respect to the line shaft drive, and to indicate this circumferential displacement through the cooperating dial scale 222 in vernier 224, provides for further precise vertical alignment with the makeready system.

Referring again to FIG. 10, lateral side adjustment is provided for the imprint cylinder, through a standard hand wheel and dial 230, of the same type as member 138 in FIG. 8, this unit being coupled to a shaft 232 which is rotatably mounted on the operator side of the machine, and which is secured to a rotatable gear 233. A lock nut 234, surrounding the shaft 232, may be tightened to lock shaft 232 in an adjusted position. The gear 233 meshes with a further adjusting gear 235 which, in turn, has an internal nut 236 formed within its center, fitted onto a threaded extension 238 of the operator side bearing support 210. The operator, by unlocking the lock knob 234 and rotating the handwheel 230, can thus cause translation of the entire shaft mechanism of the imprint cylinder 200, and this motion will be reflected in displacement of the indicating needles over the dial of the indicating mechanism of the member 230. As before, zero reference for this mechanism is set with respect to the gear side of the machine. Thus, the operator, through use of this side adjust mechanism, can modify the side position of the imprint cylinder, after the patch has been applied according to information from the instruction sheet and a trial run begun.

Numbering Section

The mountings for the numbering machines are shown in FIGS. 9 and 12. There are a variety of numbering machines commercially available, and a typical such unit is shown generally by the reference numeral 240. These machines include numbering print members, mounted on wheels or the like, and operated by cam mechanisms so as to present different numerals for printing on the web in a predetermined sequence. The numbers may be aligned along the web, or across it, depending on the particular job. As is known in the art, the numbering sequence may be a straight numerical sequence (up or down), or may involve various skips or changes, depending upon the demands of the job. In general the numbering machine is supported on a mounting wheel 241 which is fastened to a rotatable shaft 242 connected through clutch mechanism of the same type as shown in FIG. 10 (reference numerals 212–216) to the line shaft drive. On shaft 242 there is an internal alignment wheel 243 which is secured to the shaft such that when the shaft is in its zero position, a predetermined alignment scribe mark or line is underneath the edge of the indicator bar 245. This bar extends inward from the machine frame, on the operator's side.

Shaft 242 extends through side adjustable bearings (not shown) and is mounted for limited lateral adjustment with the same type of supporting and adjusting mechanism as is shown in FIG. 10 with reference to the imprint cylinder adjustment. Thus, as shown in FIG. 9, there is a rotating dial 247 which is connected to rotate with the input side of the declutching mechanism, thereby indicating a position synchronized with the line shaft drive, and there is vernier or pointer mechanism 248 which is connected to rotate with the shaft 242. The pointer and dial thus indicate any circumferential adjustment of the shaft 242 with respect to "around" zero reference.

Likewise, there is a lateral adjustment mechanism of the same type as shown in FIG. 10 (reference numerals 230–235) for adjusting the shaft 242 and the parts mounted on it laterally between the side frames of the machine. This mechanism includes the same type of hand wheel, indicator dial, and pointers, shown in FIG. 9 by the general reference numeral 250. These indicator devices are commercially available from Tejax Engineering Corporation Pawtucket, R. I., and are marked with U.S. Pat. No. 2,104,521.

It should be understood that the numbering machines 240 are mounted on a holder wheel 241 and are indexed by a cam 253, in order to advance the numbering wheels appropriately for each revolution of shaft 242. The cam is supported from a shaft 252 which is parallel to shaft 242, and mounted to move laterally with it under the control of the side adjust mechanism, and to oscillate as necessary to move the cam between an active position and a throw-off position.

Shaft 242 is provided with an appropriate scale 255 which serves as an indicating device for locating the numbering machine laterally across the path of the web. It should be understood that more than one such machine may be utilized depending upon the requirement of the job, in which case the illustrated parts are duplicated. Shaft 252 may also be provided with a suitable scale, although this is optional. The numbering wheels are offset with respect to the edge of the numbering wheel cooperating with scale 255, and this is taken into account in the mounting of the scale, and in the composing operation as explained hereafter. The numbering wheel 241 has an appropriate circumferential markings or detents indicating standard numbering machine locations.

As an option, a locator arm or gage 257 is pivotally mounted on shaft 522, and is slidable along that shaft to a position read from the scale on that shaft, then swung into position over the numbering machine, bringing the units number tangent with the L-shaped locator edges at the tip of the locator gage or arm 257. This may be accomplished by moving the numbering machine about its mounting wheel 241. With the numbering machine thus located, it is locked to mounting wheel 241. This operation may be repeated as may be necessary if additional numbering machines are used. The additional locations are determined by rotating the shaft until the next appropriate line on scale wheel 243 is into alignment with bar 245, then attaching the next numbering machine.

The lock nut **218*a* is tightened to clutch shaft 242 to the press drive, and the cam mechanism 253 for the numbering machine may be moved along shaft 252 as necessary to slide it into position to operate the numbering machine, then clamped to the shaft 252**.

File Hole Punch

FIG. 13 shows the mounting and adjustment controls for the file hole punches which are used to form the file holes or perforations FH as shown in FIG. 2. Such devices comprise a rotating punch reel 260 and cooperating rotating die reel 262. In FIG. 13 a pair of cooperating reels are shown. These each contain appropriate sockets in their surfaces, as is known in the art, to receive the cooperating punch and die members which serve to perforate the web and to push the chaf away from the moving web. As is conventional, such punch and die members can be supported in different spaced locations around the periphery of the punch and die reels 260 and 262, according to standard spacings that are made available in commercially sold units. The punch reels are supported on, and keyed to, a rotatably driven shaft 264, and the die reels are likewise supported on a parallel rotatable shaft 265. These shafts counter-rotate through mating gears (similar to gears 182, 183), such that they are synchronized, and the shaft 265 is connected to clutch mechanism, of the same type as shown in FIG. 10, connecting it to one of the gear boxes from the line shaft drive. In FIG. 13, the lock nut 266 is shown for use in tightening and loosening the clutch mechanism. The shafts 264 and 264 are tied together, for example, through the cross bar 268, such that they can be moved laterally with the same type of side adjusting mechanism as shown in FIG. 10, the two shafts moving in unison. The same type of indicating hand wheel adjustment 270 is provided, in order to shift the shafts 264 and 265 laterally with respect to the machine frame.

The circumferential position of the file hole punch mechanism is illustrated by the dial 272 which is connected to shaft 264. The dial rotates with shaft 264, with respect to an indicator or pointer 273 which is mounted on the cross bar 268, and hence is in a stationary position with respect to rotary motion, and offers a fixed zero position which is related to the "around" reference zero position of the line shaft input. The standard file hole punch locations can thus be determined by referencing the circumferential position of the reels, and the "across" location of file holes can be determined by locating the reels with respect to a scale 274 on shaft 264. Again, the scale is located to account for the offset of the punch from the reel edge.

To one side of shafts 264 and 265 there is a cross bar 275 having an appropriately graduated scale thereon, and carrying a punch reel locator arm 276. This arm is mounted to slide along the bar 275, and is also pivotable toward and away from the punch reels 260. This arrangement offers an alternative mechanism for setting lateral adjustment of the file hole punches, particularly for non-standard reels. The locator 276 can be moved to the appropriate position with respect to the scale on bar 275, according to the entry on the job sheet, and the locator then pivoted to a position closely adjacent the punch reel 260. The punch and die reel 260 and 262 can then be moved along their respective shafts until the punch is set with respect to the edge corner of the locator. In making such an adjustment, it is advisable to have a punch engaged into a die, in order to ensure that the die reel 262 is accurately aligned with the punch reel, to which the setting is being made. Once these settings are accomplished, the reels can then be secured to their respective shafts by the usual set screws (not shown).

Line Hole Punch

Figure 14:
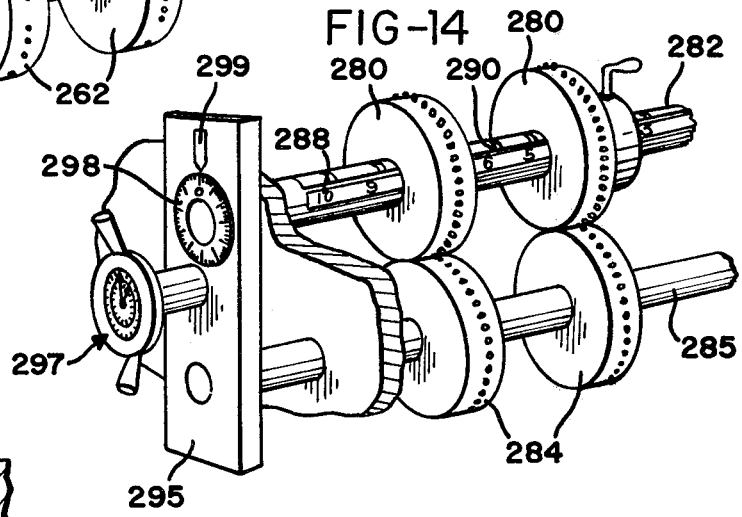
FIG. 14 shows the registering mechanism for the marginal or line hole punch and die mechanisms.
Figure 15:
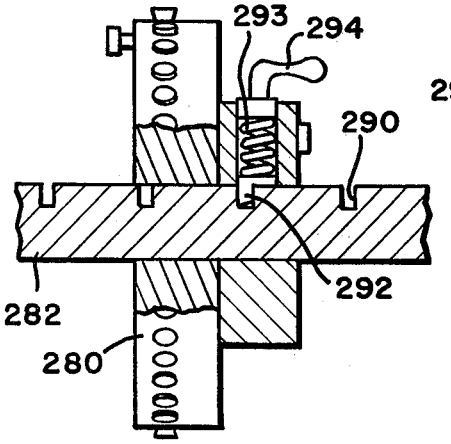
FIG. 15 shows further details of the line hole punch and die mounting.

The punch and die mechanisms for forming the line (feed) holes or marginal holes are illustrated in FIGS. 14 and 15. Again, the punch reels 280 are mounted on and keyed to a rotatably driven shaft 282, and the die reels 284 are likewise mounted on a parallelcounter rotating shaft 285. The shafts 282 and 285 are connected by appropriate gears (not shown) and in turn are driven from the line shaft. In this particular instance there is no clutch connection with respect to the gear box from the line shaft, since the line hole or marginal punches are preset in the manufacturing of the machine to reference zero (around), and are precisely referenced to the main blade of the cross-perforator to assure that, when used, the marginal holes formed in the web are precisely and continuously spaced apart.

Shaft 282 is, as was the previous case, provided with a scale 288 which provides a setting to be used with respect to the side edge of the punch reels 280 closest to the operator side of the machine. In addition, since in many machines there are standard settings for the line hole punches, shaft 282 may also be provided with a number of detent slots 290 which can receive a spring-loaded detent arm 292. This arm is pressed by spring 293 to engage in an appropriate one of the slots 290, and the spring pressure can be released through the control lever 294, which the operator can pull upward in order to release the detent from the appropriate slot.

The shafts 282 and 285 are supported in bearing cups, essentially as shown in FIG. 10, and the shafts are tied together by cross bar 295, such that a lateral adjustment mechanism 297, complete with dial indicator, of the type previously described, can be used to perform lateral adjustment of the line hole punch mechanism, as an entirety, when required. Circumferential adjustment is not provided, as mentioned previously, however, a dial 298 is provided, connected to shaft 282, and rotating with respect to a stationary pointer 299 on cross bar 295, in order to provide a zero reference position, (around) of the shafts 282 and 285 during side adjustment of the line hole punch and die reels.

Cross Perforator Adjustment

The cross perforation station is shown in FIG. 1, with the web passing between a backing or anvil cylinder 300 and first and second cross-perforation cylinders 302 and 303 (see FIG. 16 also). The second cross perforation station and cylinder is optional, and is understood to be essentially identical to that shown in FIG. 16, hence details of it are omitted to avoid duplication. The cylinder 302 is provided with mounting slots in its surface to support one or more cross perforating blades 305. The number of these blades will depend upon the length size of the form to be manufactured. The cylinder 302 is directly connected to the line shaft such that the main blade **305*a* is located at "around" reference zero. This is coincident with the zero setting of the gap centerline of the plate cylinder 120**.

The second cross-perforation cylinder, however, is provided with a clutch connection of the line shaft drive. The nature of that connection is the same as that shown in FIG. 10.

A dial 308 is attached to the shaft of the cylinder 302, and thus indicates line shaft position. The pointer 310 is fixed to the side frame, and thus indicates when cylinder 302 and the blades mounted on it, and in fact the entire line shaft system, is in the reference. Since the cross-perforation blades 305 extend across the entire web, or substantial portions thereof, and since they may be adjusted with respect to the surface of cylinder 302, no lateral adjustment mechanism is provided for this particular station. The circumferential (around) adjustment for the second cross-perforation cylinder 303 is in all essential respects the same as shown in FIG. 10, including a suitable releasable clutch, and appropriate dial and pointer (as 222 and 224) to indicate the displacement of cylinder 303 from zero reference.

Vertical Perforator

Figure 17:
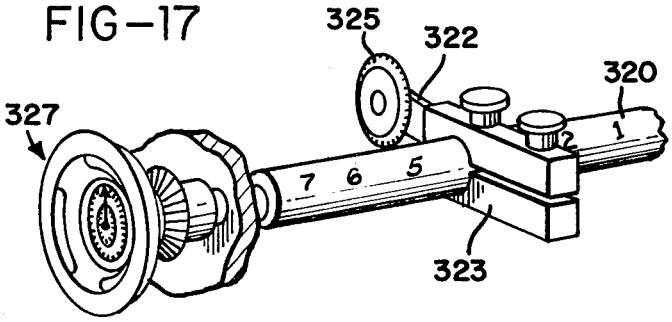
FIG. 17 shows the mechanism for mounting and registering one or more slitting wheels of a vertical perforator or slitter.

The vertical or longitudinal perforator and its adjustable mounting is shown in FIG. 17. It should be understood, however, that this mechanism is in all material respects the same as is used in connection with the vertical slitter, the difference being in the type of cutting wheel employed. Also, the adjustment mechanisms are the same, and only the driving mechanisms slightly different, for the skip perforation station.

A shaft 320 is provided with a scale along its length, and an arm 322 is attached to shaft 320 through a clamp mechanism 323. A discontinuous vertical perforating wheel 325 is supported for free rotation on the end of arm 322, being adjusted into engagement with the web, against an appropriate backing drum 326 (FIG. 1) such that the wheel 325 is rotated by the force of friction and serves to make intermittent lengthwise cuts in the web. By releasing clamp 323 it is possible to slide the arm 322 lengthwise of shaft 320 to any position with respect to the scale, as may be determined from the job sheet. In addition, shaft 320 is also provided with an external handwheel and indicator mechanism 327, of the same type previously described, which may be initially set at zero, and used either for corrective alignment, or to enter a fractional lateral adjustment of the cross-perforator wheel 325, depending upon the requirements of the job.

The vertical slitter differs from the vertical perforator shown in FIG. 17 in that a wheel with a continuous cutting edge is used in place of the wheel 325. The mounting and adjustments are in other respects identical.

The skip perforator, if used, differs only in details which are per se known in the art. It can form intermittent longitudinal perforations such as SP (FIG. 2), and usually is mounted to cooperate with the anvil cylinder 300. The shaft 320 is mounted for limited rotation, and an adjustable cam or tilting mechanism is provided which will rotate the cutting or perforating wheel into and out of engagement with the web. Thus the beginning and end of a partial vertical perforation, such as the vertical line SP on FIG. 2, can be determined by adjusting this tilting mechanism to bring the slitting wheel into contact with the web at a predetermined location, holding the wheel there for a predetermined dwell period, and then tilting the arm to move the wheel away from the web. Again, side adjustments are made in the same manner as described above.

System Use

In a typical use of the system, the composing room is provided with suitable copy of the form to be produced on the press. This copy might be, for example, the original art work or layout showing the composition of the form, and this could be in a set of several related pieces, or where the form is to be a further production of an earlier job, the copy could be a sample form or set of forms saved from previous production.

In one successful embodiment the artwork is pasted up with appropriate symbols of elements such as file holes, line holes, numbering, imprinting, and partial or skip perforations. Then a negative is made from the market artwork and a print from the negative, showing the location of all these elements, is provided the composer. The symbols so added are marked, then printing plates are made from the negative, with the symbols removed by opaquing during platemaking.

The copy is placed on the composing table surface 60 in the same orientation as it will be printed, and appropriately aligned with the grid work on the template 62 and the zero reference of the template. At this time the overlay 64 is folded back out of the way. The form is laid out appropriately with respect to the head and tail areas of the composing table, as previously described, and is located with respect to the "across" and "around" coordinate numbers, the "across" numbers running horizontally on the grid work and the "around" numbers running vertically on the table, as shown in FIG. 3. For example, if a form such as shown in FIG. 2 is of such a width that it can be printed double stream and two around (four up), then the copy may be located on the upper right quadrant of the composing table, and appropriate readings made. The form width is added to the "across" readings for the second stream, and the form length is added to the "around" readings for the other forms.

The composer is provided with a job sheet, a typical such sheet being shown in Appendix A, parts 1 and 2. This sheet will be filled in with various information concerning identification of the job, type of paper to be used, type and color of ink, etc., and this information may have already been completed before the job sheet reaches the composing room. It is the job of the composer, using the composing tables such as shown in FIG. 3, to determine and record information under the heading "Press Set Up" as shown in Appendix A. Customarily the composer will start with the unwind unit and compile and record the necessary data in the same sequence as the web p progresses through the machine, left to right as viewed in FIG. 1. Preferably, entries will be made in a common fraction denominator, e.g., thirty-seconds of an inch.

Knowing the width of the web, and the width of the particular job, the composer determines the location of the edge of the supply roll with respect to the gear side of the machine. This information is then recorded under the title "*Unwind Position*". The cursor may be used if necessary to determine fractional measurements between the unit measurements of the overlay, which is placed over the copy once the copy is appropriately located on the table grid 62. In many jobs the printing or other operations will be up to the edge of the web, and this edge is set with the "across" zero reference four inches from the inside of the gear side frame. As noted, in this position the unwind shaft is located at its zero side position. Should the job call for a trim cut (longitudinal) near the edge of the web, it may be convenient to set the unwind at minus location, such that the edge of the work is at the across zero reference.

Two reference systems are available for aligning the printed matter or composition to the press "zero" positions on the composing table and the grid 62. One system provides registration of the composition to the negative and the plate through the use of pins in the sockets 65 (FIG. 3) and comparable pins on a plate bender, which is a well known tool, to assure accurate location and bending of the plate ends to be clamped into the gap 121. The pin system can also be used as standard reference for accurate positioning of a negative, plate or printed form in order to determine press function positions. This involves the location of the composition on the table grid 62, as previously mentioned.

A second system involves the use of center line marks which are carried from the art work to the plate and referenced to zero. These lines are then aligned with corresponding center line marks on the grid 62 and on the plate bending equipment.

After the form image is accurately located on the plate, the plate is precisely located on cylinder 120, both circumferentially and laterally. This is accomplished by a combination of three references. The edge of the plate is aligned with the gear side edge of the plate cylinder, as shown in FIG. 8, and the bend in the tail of the plate is precisely formed such that when the bend is inserted into the plate clamp (not shown) it provides an accurate "around" reference. In practice, the plate image is restricted to an inlet somewhat from the edge side of the plate and from the plate tail.

In some jobs it may be necessary, therefore, to print "in the gap". In other words, it may be necessary to locate from the image closer to the longitudinal (around) zero reference position than is possible with the plate cylinder and blanket cylinder in the zero reference position. (For explanation, reference is made to an offset printing station; however, those skilled in the art will understand that the principles apply also to other types of printing stations such as letterpress, etc.) Therefore, it may be necessary for the composer to enter on the job sheet an appropriate "around" figure which will identify the amount of circumferential adjustment which will be necessary to move the plate and blanket cylinders (via the aforementioned differential mechanism) so as to locate the image close to the "around" zero reference location. Similarly, where it is necessary for the image to locate closer to the margin of the form than the spacing of the plate image from the side edge of the plate, appropriate "across" adjustment entries may be made.

Next, the composer determines the location of the imprint plates or patches, such as are typically shown in FIG. 11. The imprint plate or patch is generally a rubber or similar flexible letterpress plate which is fastened with an adhesive to the supporting cylinder 200. The imprint plate may bear a particular image to be printed, or it may be designed merely to overprint a particular area, such as the region as shown mottled at the lower right corner on the form F-3 in FIG. 2. The location of the imprint patch is determined by the composer by placing the target 72 of cursor 68 at the image corner of the imprint nearest the head of the plate and on the operator side of the press. With the cursor in this position across and around recordings are made from the cursor and the overlay grid, and entered under the title "Imprint" on the job sheet.

Next, the composer determines the location of one or more numbering machines at the numbering station 35, which is also shown in FIG. 12. The composer places the appropriate rectangle on the cursor, marked "unit wheel," around the units' number of the multi-digit number sequence. The four rectangles are appropriately offset from the target 72, and that rectangle is used whose legend reads in the same direction as the numbers to be printed. For the eight digit order number which is shown on the sample form in FIG. 2, the composer would place the rectangle to the right of the target over the units' position and record at least the across and around locations of the target, using the grid and the scales 73. It might be necessary to record additional numbering machine locations depending upon the number capacity of the machines available to press operator. If the numbers were inverted, the composer would use the rectangle to the left of the target, with the legend "unit wheel" inverted. The offset of the appropriate rectangle from the target corresponds to the offset of the units wheel on the numbering machine from the side edge of its mount 241 cooperating with scale 255.

If a different type of numbering machine, not fitted to the offsets of the system, is used, then the center lines of target 72 are placed tangent to the units number at the corner of that number nearest the gear side and tail of the composing grid 62. The "across" and "around" locations of the target center are recorded, and this information is used to locate the guide 257 (FIG. 12) to set the numbering machine.

Referring to FIGS. 3 and 4, the cursor 68 is provided with a number of circles laid out along the vertical center line. The larger circles are labelled A, B . . . R, these being in the form of a standard pattern of punch (and die) sockets on the reels of the file punch and die shown in FIG. 13. The larger circles are in patterns where the file hole punches normally are located two-around or four-around. The smaller circles are arranged in a different pattern corresponding to these normally used when printing three-around and six-around. It should be noted that the target 72 is also the initial circle for both patterns, and hence is also labelled Aa.

The composer determines the punch/die sockets to be used in the reel, by comparing a file hole chart for the reels available on the machine with the holes required in the form, and records the size and pattern on the record sheet (Appendix A-2). Then he places the cursor onto the overlay 64 (FIG. 3) with the appropriate coded circle overlying the file hole on the artwork which is closest to the tail (top) area of the overlay. For example, if the appropriate file hole location to be used on the reel corresponds to G, that hole will be placed over the uppermost file hole appearing on the artwork, taking care to align the horizontal and vertical lines of the cursor with the grid pattern of the overlay 64. Then the composer reads and records the "around" and "across" locations of the center target 72. In the press, the position of the Aa file punch on the reel will be at reference zero (around) when no circumferential adjustment is introduced, and the amount of this adjustment required for the particular job will be recorded as above described. Thus, the composer chooses the appropriate file punch locations to achieve the proper spacing and location of the file punch holes, and to do so with a minimum of circumferential adjustment of the reels.

The across or lateral adjustment is also recorded as the center of the target 72, and the scale 274 (FIG. 13) is appropriately offset by the spacing of the file punches from the side of the reel, so that the across setting can be made directly from the recorded reading.

If an unusual file hole punch is encountered, and if there is no standard chart, the alternate arrangement can be used, in which case the composer places the target 72 over each file hole location, records the "across" and "around" readings, and instructs the operator to utilize the scale 275 and movable alignment guide 276 to set up the file hole punch station accordingly.

The next step is to determine the marginal or line hole punch locations. Circumferential hole location is not required, since this is a manufacturing setting for the press. Thus, the composer needs only to determine and enter the lateral dimension for the line hole punch, and this is determined by placing the target 72 of the cursor over the line hole location, on the gear side of the layout, and recording the "across" reading on the job sheet. It should be noted that in a particular job there may be a plurality of line hole punches used, for example, if the form shown in FIG. 2 is printed double stream, four line hole punches will be required, one for each marginal area of the two forms to be printed simultaneously. Also, if standard line hole spacings are used, it may only be necessary to enter appropriate information to identify the correct detent notch 290 (FIG. 15) to be used.

Next, the composer determines the location of cross-perforation lines CP. The location of the main blade 305*a* which form the cross perforations in the web is a manufactured setting in the press, at zero reference (around). This determines the location of the folding cross perforations on the printed forms on the web. Thus, a reading for cross-perforation at these maximum locations is not necessary. There are standard spacings of slots in cylinder 302, where blades can be located to perforate between forms printed two-around, three-around, or four-around. In general, the blades 305 are full width of the web, and the composer need only enter the number and type of standard spacing on the job sheet to indicate where blades should be mounted.

There may be jobs where partial cross-perforations may be desired, such as the horizontal partial perforation PP (FIG. 2) which determines an area that can be detached with respect to the remainder of the form. Generally such partial perforations will be made at a separate station from the first cross-perforation, as indicated on FIG. 1, and a appropriate entries may be made under the heading "*Internal Cross Perf*", as shown on the job sheet. Only a circumferential reading is required, and the composer obtains this by setting the vertical cursor line 70 over the location of the necessary partial or inner cross perforation, and recording the appropriate reading from the horizontal cursor center line on the job sheet. This cylinder also has standard slot spacing, and the length of the perforation is determined by the length of the inserted blade. The composer thus enters the "across" reading for one end of the line PP, and this determines the location of the blade along the slot. The second cross-perforation cylinder is circumferentially adjustable, as mentioned, and a suitable across scale is located on it, or next to it such as scale 207 (FIG. 11).

Vertical perforations are located and recorded in similar fashion, however, here only the lateral dimension is needed. The target of the cursor is located on the perforation line, for example, the lines VP on FIG. 2, and the corresponding readings are located and recorded on the job sheet. In instances where the particular job may be running a multiple of images across, one or more vertical slitter locations also will be desired. This again is a lateral dimension only, determined in the same manner as for the vertical perforation line, and recorded under the heading "*Slitters*", on the job sheet. The slitter might be used, for example, to separate the web into parts after the other machine operations are completed, ahead of the delivery station.

In instances such as might require the partial vertical perforation SP, shown at the bottom of FIG. 2, it is necessary to record lateral dimension and the beginning and end of the partial vertical perforation, and these are determined in similar fashion and recorded on the sheet. These dimensions determine the lateral location of a skip perforation disc at the appropriate station (as shown in FIG. 1) and also d determine the points around the circumference at which the skip perforation disc is lowered to engage the web, and raised to disengage from the web.

The foregoing operations have been described with reference to the composing table, overlay, and cursor shown in FIGS. 3 and 4. Essentially the same operations are accomplished if the modified composing system (FIG. 5) is used. However, since the Digitrac unit 80 provides complete numerical readout, the numbers appearing in its display are recorded, and its cursor 86 does not require the scales corresponding to the scales 73. However, the cursor 86, in addition to the target 87, will be provided with the various rectangles to locate the unit wheels of the numbering machines, and with the various circles to indicate the patterns of the file hole punch and die.

While the methods and forms of apparatus herein described constitute preferred embodiments of this invention, it is to be understood that the invention is not limited to these precise methods and forms of apparatus, and that changes may be made therein without departing from the scope of the invention.

Docket 6237

PRESS # _____

OPERATOR _____

1200 PRESS MAKEREADY SYSTEM

NUMBER STREAMS _____

JOB _____ QUANTITY _____

P.O. _____ CUSTOMER _____

PLANT _____ DATE RUN _____

DESCRIPTION

| | | | | | | |
|---|---|---|---|---|---|---|
| Item | | | | | | |
| Part | | | | | | |
| Width x Length | | | | | | |

PAPER

| | | | | | | |
|---|---|---|---|---|---|---|
| Color | | | | | | |
| Weight/Width | | | | | | |
| Grade | | | | | | |

INK COLOR

| | | | | | | |
|---|---|---|---|---|---|---|
| Unit 1 | | | | | | |
| Unit 2 | | | | | | |
| Unit 3 | | | | | | |
| Unit 4 | | | | | | |
| Imprint | | | | | | |
| Number | | | | | | |

PRESS SET UP

| | | | | | | |
|---|---|---|---|---|---|---|
| Unwind Position | | | | | | |

PLATES (AROUND _ACROSS)

| | | | | | | |
|---|---|---|---|---|---|---|
| Unit 1 | BACK ☐ | BACK ☐ | BACK ☐ | BACK ☐ | BACK ☐ | BACK ☐ |
| Unit 2 | BACK ☐ | BACK ☐ | BACK ☐ | BACK ☐ | BACK ☐ | BACK ☐ |
| Unit 3 | BACK ☐ | BACK ☐ | BACK ☐ | BACK ☐ | BACK ☐ | BACK ☐ |
| Unit 4 | | | | | | |

IMPRINT NONE ☐ NUMBER AROUND _____

| | | | | | | |
|---|---|---|---|---|---|---|
| Top To Head | | | | | | |
| | | | | | | |
| | | | | | | |
| | | | | | | |

NUMBERING NONE ☐ BACK ☐ FWD ☐ SKIP _____ STRAIGHT ☐ CONVEX ☐ START NO. _____ NUMBER AROUND _____ FONT _____

| | | | | | | | |
|---|---|---|---|---|---|---|---|
| Top To Head | S C | | | | | | |
| | S C | | | | | | |
| | S C | | | | | | |
| | S C | | | | | | |
| | S C | | | | | | |

APPENDIX A-1

Docket 6237

PRESS SET UP CONTINUED

| Item | | | | | | |
|---|---|---|---|---|---|---|
| Part | | | | | | |

MICR NUMBERING NONE ☐ NUMBER AROUND ____ BACK ☐ FWD ☐ TYPE ____ DIGITS ____ CONSEC. ____

| | AROUND | ACROSS | | | | |
|---|---|---|---|---|---|---|
| Top To | | | | | | |
| | | | | | | |
| | | | | | | |
| | | | | | | |

FILE HOLE PUNCH NONE ☐ SIZE ____ C TO C ____ PUNCH PATTERN ____

| | | | | | | |
|---|---|---|---|---|---|---|
| Gear Side | | | | | | |
| Center | | | | | | |
| Operator Side | | | | | | |

LINE HOLE PUNCH NONE ☐ C TO C ____

| | | | | | | |
|---|---|---|---|---|---|---|
| Center | | | | | | |
| | | | | | | |

FOLDING CROSS PERF NONE ☐ TIES ____ CUTS ____ NUMBER AROUND ____

| | | | | | | |
|---|---|---|---|---|---|---|
| | | | | | | |

INTERNAL CROSS PERF NONE ☐ NUMBER AROUND ____

| | | | | | | |
|---|---|---|---|---|---|---|
| Around Blade | CUTS ____ TIES ____ | CUTS ____ TIES ____ | CUTS ____ TIES ____ | CUTS ____ TIES ____ | CUTS ____ TIES ____ | CUTS ____ TIES ____ |
| Partial Length—Loc. | | | | | | |

VERTICAL PERF NONE ☐

| | | | | | | |
|---|---|---|---|---|---|---|
| Stub Across | | | | | | |
| Wheel | CUTS ____ TIES ____ | CUTS ____ TIES ____ | CUTS ____ TIES ____ | CUTS ____ TIES ____ | CUTS ____ TIES ____ | CUTS ____ TIES ____ |
| 1st Int. Across | | | | | | |
| Wheel | CUTS ____ TIES ____ | CUTS ____ TIES ____ | CUTS ____ TIES ____ | CUTS ____ TIES ____ | CUTS ____ TIES ____ | CUTS ____ TIES ____ |
| 2nd Int. Across | | | | | | |
| Wheel | CUTS ____ TIES ____ | CUTS ____ TIES ____ | CUTS ____ TIES ____ | CUTS ____ TIES ____ | CUTS ____ TIES ____ | CUTS ____ TIES ____ |

SLITTERS NONE ☐

| | | | | | | |
|---|---|---|---|---|---|---|
| Gear Side | | | | | | |
| Center | | | | | | |
| Operator Side | | | | | | |

APPENDIX A-2

What is claimed is:

1. A method of makeready for a press having an unwind apparatus for supporting a rolled web of material and a plurality of rotatable members in spaced alignment defining a path for the web and arranged to perform operations on said web such as printing, perforating, numbering, punching or slitting, said members being rotatable in synchronism and being adjustable laterally and/or circumferentially with respect to the web path;

comprising the steps of establishing a reference position in the unwind apparatus for the rolled web, establishing separate side reference positions for each of said rotatable members having a lateral adjustment with respect to the unwind reference position, establishing a circumferential reference position for each of said rotatable members with respect to each other, providing side measuring and circumferential measuring scale devices associated with each of the adjustable rotatable members to indicate lateral displacement and rotary displacement of the corresponding rotatable member from the reference positions, establishing a coordinate layout system having reference marks corresponding to the reference positions and having scales in dimensions corresponding to said scale devices, preparing a chart of dimensional settings using a representation of the desired product in conjunction with the layout system whereby measurements are provided for lateral and circumferential adjustment of the adjustable rotatable members using their respective scale devices, and the settings for the rotatable members can be accomplished with precision to minimize their adjustment once the web is threaded through the press and a run is started.

2. In a web press combining printing and other operations such as punching, numbering or perforating of a web, means forming a plurality of stations arranged to define a path along which the web is fed, a drive connected to each of the stations to operate them in sychronism, rotary means incorporated in said stations and functional to perform a repetitive operation on the passing web, means connecting said rotary means to said drive and providing for limited rotary displacement of at least some of said rotary means with respect to said drive, adjustable mounting means supporting at least some of said rotary means in said stations for lateral displacement with respect to said web, and adjustment mechanisms available to the press operator to cause rotary and/or lateral displacement of the adjustable said rotary elements;

the improvement comprising scale and indicator means coupled to said adjustment mechanisms to indicate rotary and/or lateral reference positions of said rotary elements and to indicate lateral and/or rotary displacement of the adjustable said rotary elements with respect to such reference positions, and a layout device coordinated to said adjustment mechanisms and provided with measuring scales correlated to said scale and indicator means whereby job instructions for precise makeready settings of said adjustment mechanisms can be prepared directly from a job layout located on said layout device.

3. Apparatus as defined in claim 2, wherein said layout device includes a graduated surface for locating the job layout, such as artwork, with reference to the available operating area of the rotary means on the web, and a graduated overlay for locating specific regions of the job layout within that operating area.

4. Apparatus as defined in claim 2, wherein said device includes a graduated surface for locating the job layout to the available operating area of the rotary means, and measuring means movable in two dimensions over such surface and operable to provide coordinate measurement readouts for the location of specific regions of the job layout within the operating area.

5. For use with a web press combining printing and other operations such as punching, numbering or perforating of a web at a plurality of stations along a path of the web and including commonly driven rotary elements in said stations functioning to perform a repetitive operation on the passing web, and also including means providing for rotary displacement of at least some of said rotary elements and for lateral displacement of at least some of said rotary elements with respect to said web, said press having adjustment mechanisms to cause rotary and/or lateral displacement of the adjustable rotary elements and scale and indicator means coupled to said adjustment mechanisms to indicate reference positions and to indicate lateral and/or rotary displacement of the adjustable said rotary elements with respect to such reference positions;

a layout device coordinated to said adjustment mechanisms and provided with measuring scales correlated to said scale and indicator means whereby job instructions for precise makeready settings of said adjustment mechanisms can be prepared directly from a job layout located on said layout device.

6. Apparatus as defined in claim 5, wherein said layout device includes a graduated surface for locating the job layout, such as artwork, with reference to the available operating area of the rotary elements on the web, and scale members for locating specific regions of the job layout within that operating area.

7. Apparatus as defined in claim 6, including a cursor member cooperable with said scale members and containing markings related to the graduations to define precise locations for the adjustment of the rotary press elements to perform the particular job.

8. Apparatus as defined in claim 7, wherein said scale members are carried on a transparent overlay correlated to the graduated surface, and said cursor is a transparent member positionable on top of said overlay.

9. Apparatus as defined in claim 6, including measuring means movable in two dimensions over such surface and operable to provide coordinate measurement readouts for the location of specific regions of the job layout within the operating area.

* * * * *